US008235015B2

(12) United States Patent
Murata

(10) Patent No.: US 8,235,015 B2
(45) Date of Patent: Aug. 7, 2012

(54) INTERNAL COMBUSTION ENGINE WITH VARIABLE VALVE GEAR

(75) Inventor: Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 389 days.

(21) Appl. No.: 12/710,010

(22) Filed: Feb. 22, 2010

(65) Prior Publication Data

US 2010/0212619 A1 Aug. 26, 2010

(30) Foreign Application Priority Data

Feb. 23, 2009 (JP) ..... 2009-039232

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 7,568,458 B2 * 8/2009 Roth et al. ..... 123/90.17

FOREIGN PATENT DOCUMENTS

| | | | |
|---|---|---|---|
| JP | 3-88907 | A | 4/1991 |
| JP | 3-202602 | A | 9/1991 |
| JP | 9-177517 | A | 7/1997 |
| JP | 9-177572 | A | 7/1997 |
| JP | 11-141313 | A | 5/1999 |
| JP | 2003-13716 | A | 1/2003 |
| JP | 2004-257373 | A | 9/2004 |
| JP | 2005-214141 | A | 8/2005 |
| JP | 2006-105062 | A | 4/2006 |
| JP | 2008-261344 | A | 10/2008 |

* cited by examiner

*Primary Examiner* — Ching Chang
(74) *Attorney, Agent, or Firm* — Birch, Stewart, Kolasch & Birch, LLP

(57) ABSTRACT

Each cylinder is provided with a first intake valve and a second intake valve, and a first intake cam for driving the first intake valve and a second intake cam for driving the second intake valve are coaxially pivotally supported on an intake camshaft. A first cam phase change mechanism which varies respective phases of the first and second intake cams relative to a crankshaft of the internal combustion engine is combined with a second cam phase change mechanism which varies a phase of the second intake cam relative to the first intake cam. The second cam phase change mechanism is set to have a variable-phase angular range wider than that of the first cam phase change mechanism.

5 Claims, 6 Drawing Sheets

CROSS SECTION A-A

INTERNAL COMBUSTION ENGINE WITH VARIABLE VALVE GEAR

BACKGROUND OF THE INVENTION

1. Field of the Invention

The present invention relates to an internal combustion engine with a cam phase change mechanism capable of changing the phase of an intake cam.

2. Description of the Related Art

Conventionally, there are internal combustion engines that comprise a cam phase change mechanism as a variable valve gear, which changes the phase of an intake cam to vary the opening and closing timings of an intake valve. Further, a technique has been developed in which the cam phase change mechanism is applied to internal combustion engines that are provided with a plurality of intake valves for each cylinder. According to this technique, the opening and closing timings of only some of the intake valves are varied in accordance with the engine load and speed.

In one such internal combustion engine, the opening and closing timings of the specific intake valves are delayed by the cam phase change mechanism, based on the operating state of the engine, whereby the open periods of the specific intake valves, along with those of ones not subject to delay control, can be extended (Jpn. Pat. Appln. KOKAI Publication No. 3-202602).

In the internal combustion engine described in the above patent document, vane-type cam phase change mechanisms formed of vane-type actuators have become widely used to make valve trains compact. Due to structural restrictions, however, these vane-type cam phase change mechanisms cannot easily produce great phase differences. Accordingly, the opening and closing timings of the intake valves cannot be substantially changed, so that it is difficult to considerably mitigate pumping loss by greatly extending the valve-open period.

SUMMARY OF THE INVENTION

The object of the present invention is to provide an internal combustion engine with a variable valve gear, capable of delaying the closing timings of intake valves without failing to make a valve train compact and of extending the valve-open period, thereby greatly mitigating pumping loss.

In order to achieve the above object, the present invention provides an internal combustion engine with a variable valve gear, wherein each cylinder is provided with a first intake valve and a second intake valve, and a cam for driving the first intake valve and a cam for driving the second intake valve are coaxially pivotally supported on an intake camshaft, the internal combustion engine comprising a first cam phase change mechanism which varies respective phases of the cams for driving the first and second intake valves relative to a crankshaft of the internal combustion engine, and a second cam phase change mechanism which varies a phase of the cam for driving the second intake valve relative to the cam for driving the first intake valve, the second cam phase change mechanism being set to have a variable-phase angular range wider than that of the first cam phase change mechanism.

Thus, the valve-open period can be extended by making the variable-phase angular range of the second cam phase change mechanism, that is, phase differences between the respective opening and closing timings of the first and second intake valves, wider than that of the first cam phase change mechanism. By performing the delay angle control and valve-open period increasing control in, for example, low-load, low-speed operation, therefore, pumping loss can be considerably mitigated to greatly improve the fuel efficiency. Further, in-cylinder flow can be enhanced by increasing the phase differences between the respective opening and closing timings of the first and second intake valves. Thus, combustion stability can be improved even with mitigated pumping loss and at a low actual compression ratio with a small amount of air, and the fuel efficiency can be further improved. Since mixing between air and fuel is also enhanced, moreover, emission of unburned components in exhaust gas can be reduced.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

One embodiment of the present invention will now be described with reference to the accompanying drawings.

Figure 1:
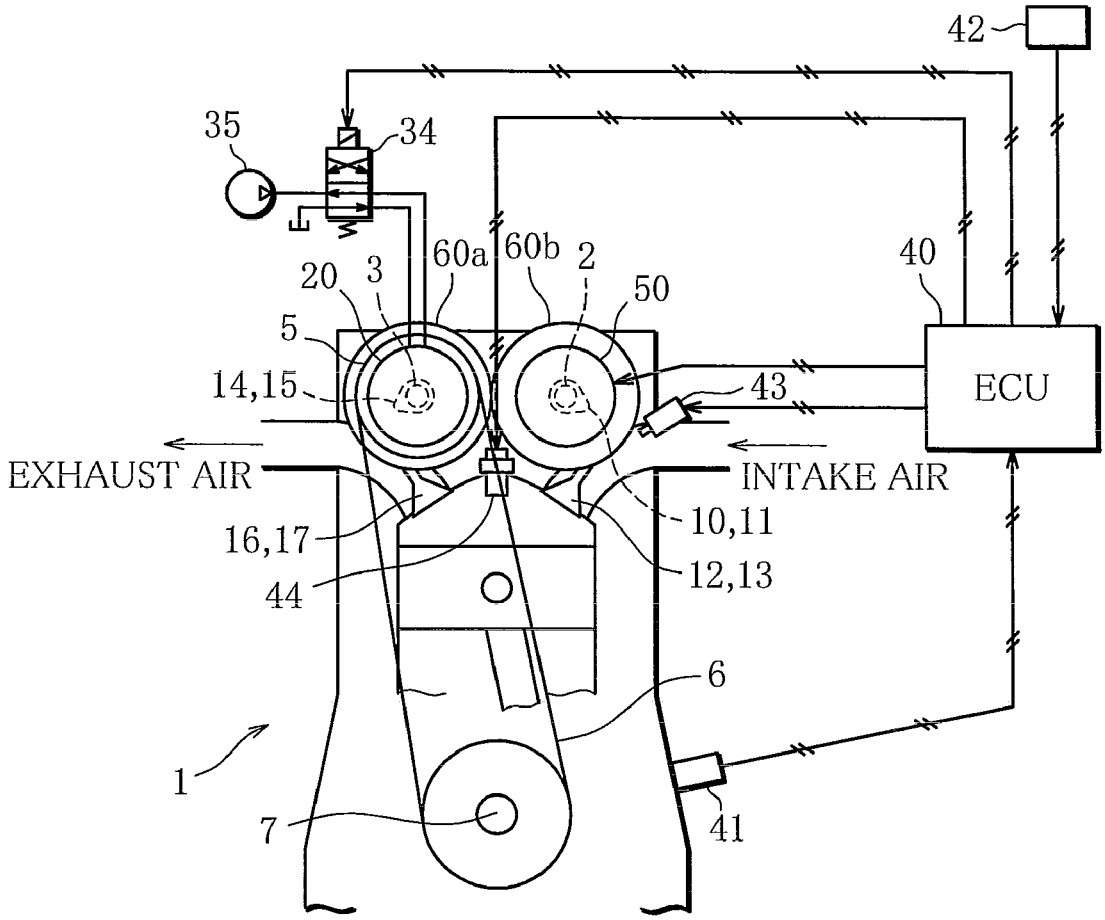
FIG. 1 is a schematic structure diagram of an engine according to one embodiment of the invention.

FIG. 1 is a schematic structure diagram of an internal combustion engine (engine 1) with a variable valve gear according to the present embodiment.

As shown in FIG. 1, the engine 1 of the present embodiment comprises a DOHC valve train. A cam sprocket 5 is connected to the front end of an exhaust camshaft 3 of the engine 1. The cam sprocket 5 is coupled to a crankshaft 7 by a chain 6. Further, the exhaust camshaft 3 and an intake camshaft 2 are coupled to each other through gears 60*a* and 60*b*. As the crankshaft 7 rotates, therefore, the exhaust camshaft 3 is rotated together with the cam sprocket 5, while the intake camshaft 2 is rotated by the gears 60*a* and 60*b*. Intake valves 12 and 13 are opened and closed by intake cams 10 and 11 on the intake camshaft 2, and exhaust valves 16 and 17 by exhaust cams 14 and 15 on the exhaust camshaft 3.

Figure 2:
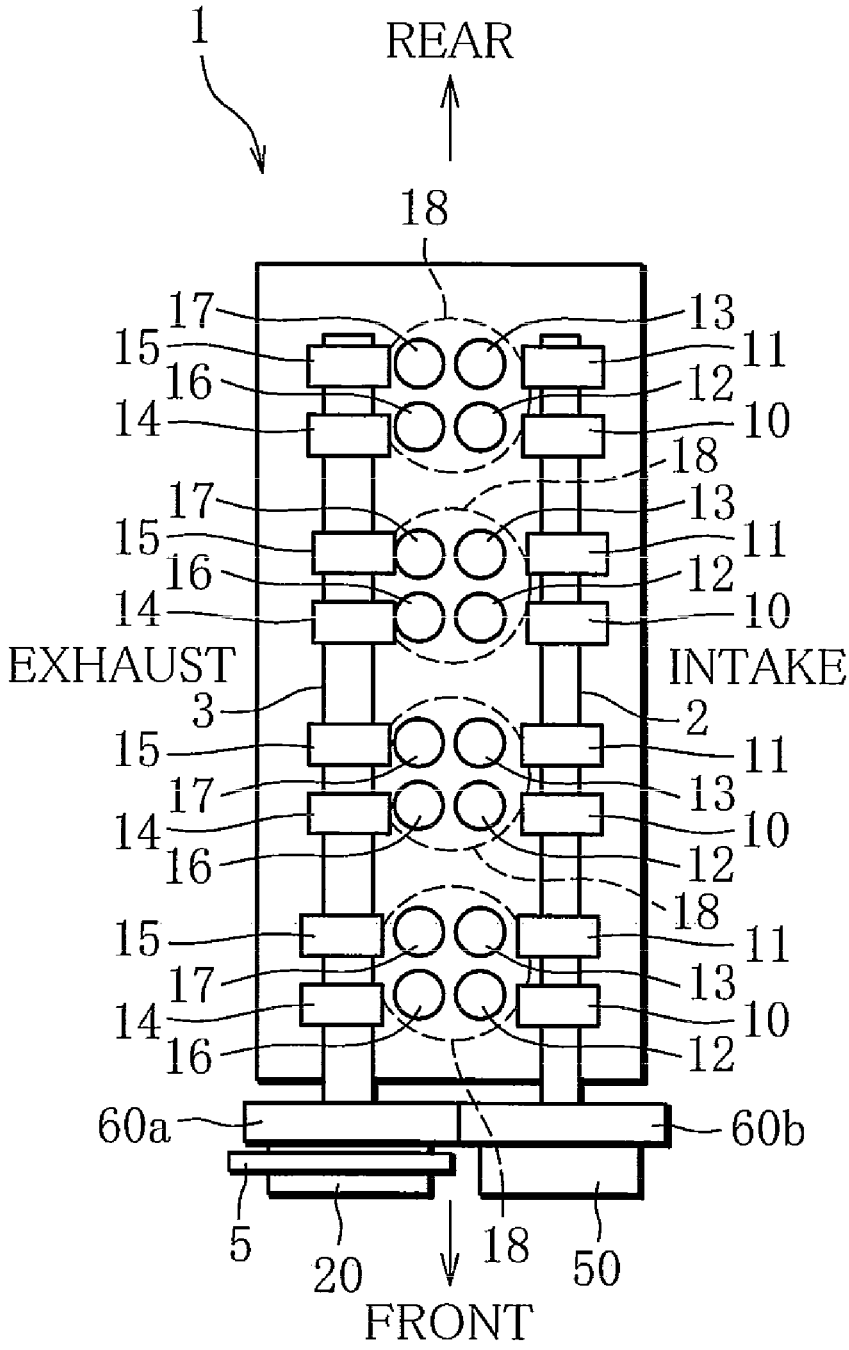
FIG. 2 is a schematic structure view of a valve train of the engine.

FIG. 2 is a schematic structure view of the engine 1.

As shown in FIG. 2, the engine 1 is provided with a first cam phase change mechanism 20 on the front end portion of the exhaust camshaft 3 and a second cam phase change mechanism 50 on the front end portion of the intake camshaft 2.

Each cylinder of the engine 1 is provided with two intake valves (first and second intake valves 12 and 13) and two exhaust valves 16 and 17. The first and second intake valves 12 and 13 are arranged longitudinally on the right of the central part of a combustion chamber 18. The two exhaust valves 16 and 17 are arranged longitudinally on the left of the central part of the chamber 18. The first and second intake valves 12 and 13 are driven by the first and second intake cams 10 and 11, respectively. As the first and second intake valves 12 and 13 are arranged in place, the first and second intake cams 10 and 11 are alternately arranged on the intake camshaft 2.

A vane-type cam phase change mechanism formed of a conventional vane-type hydraulic actuator is used as the first cam phase change mechanism 20. The first cam phase change mechanism 20 is configured so that a vane rotor is pivotably disposed in a housing to which the gear 60*a* is fixed and the exhaust camshaft 3 is fixed to the vane rotor. The cam sprocket 5 is fixed to the exhaust camshaft 3.

As shown in FIG. 1, an oil control valve (hereinafter referred to as OCV) 34 is connected to the first cam phase change mechanism 20. The first cam phase change mechanism 20 has a function to vary the rotational angle of the gear 60*a* relative to the cam sprocket 5 by pivoting the vane rotor with a hydraulic fluid, which is supplied from an oil pump 35 of the engine 1 to an oil chamber between the vane rotor and the housing as the OCV 34 is switched. Specifically, the first cam phase change mechanism 20 can continuously adjust the phase of the intake camshaft 2 relative to the crankshaft 7, that is, the opening and closing timings of the first and second intake valves 12 and 13.

Figure 3:
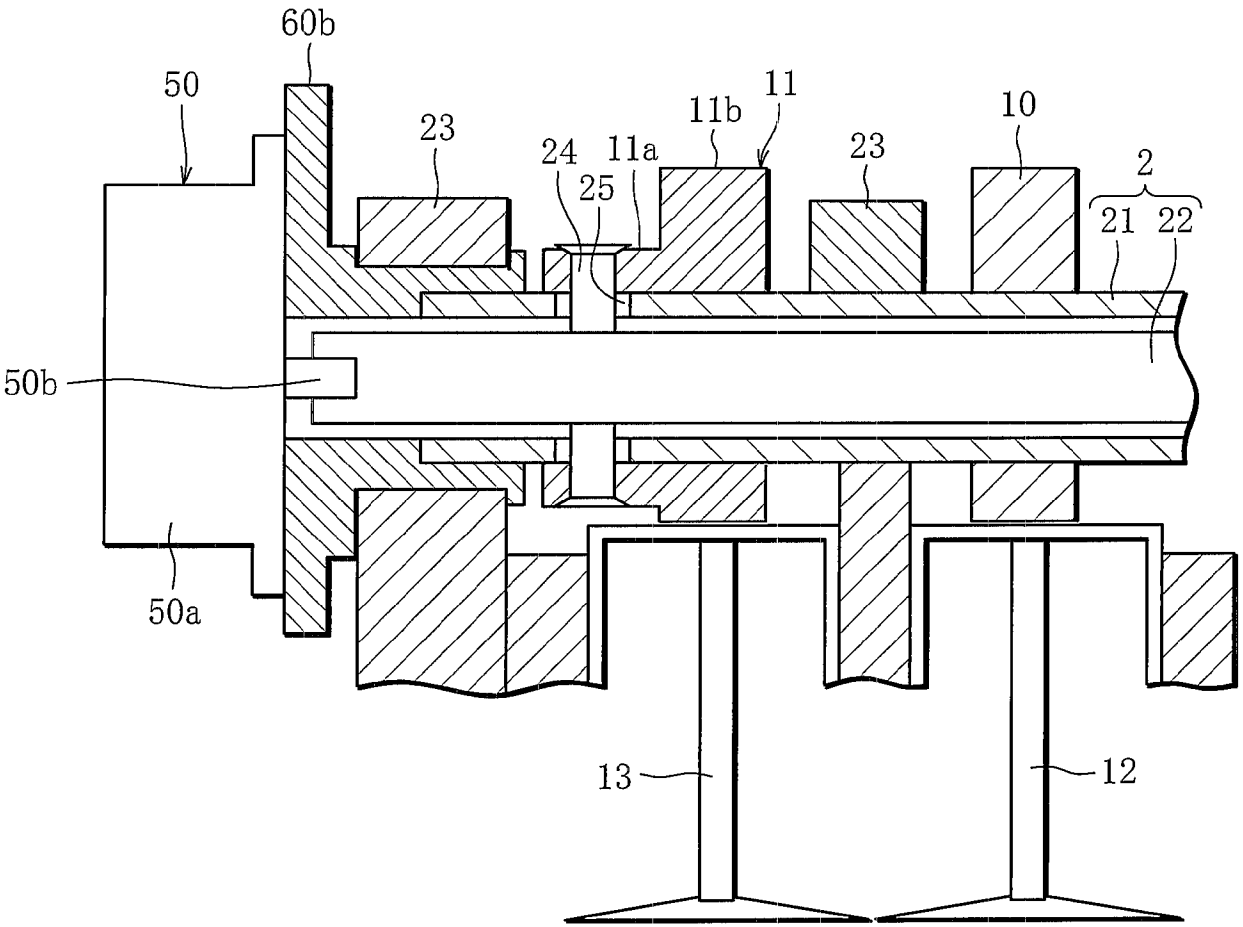
FIG. 3 is a longitudinal sectional view showing the structure of an intake camshaft.
Figure 4:
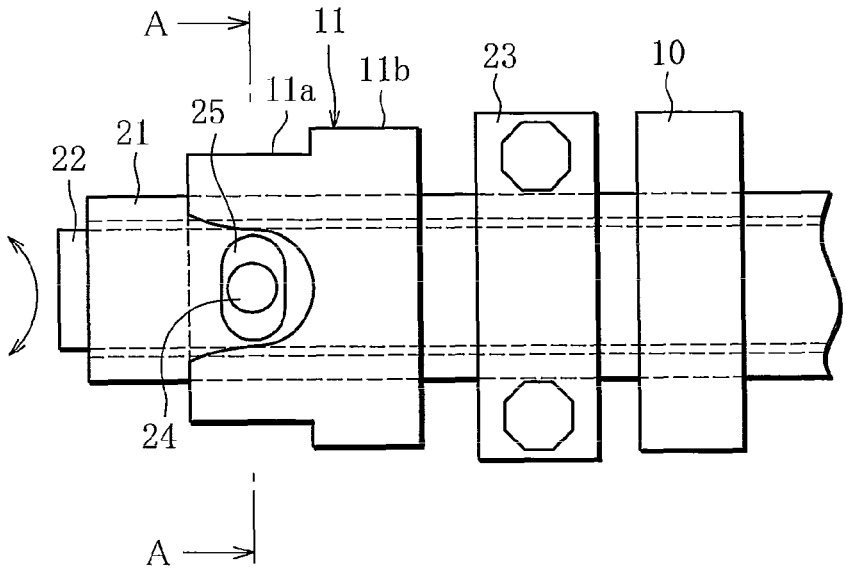
FIG. 4 is a top view showing the structure of a mounting portion for a second intake cam.
Figure 5:
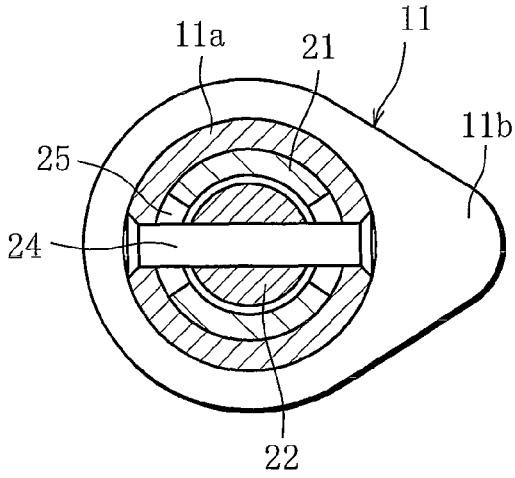
FIG. 5 is a sectional view showing the structure of the mounting portion for the second intake cam.

FIGS. 3 to 5 are structure views of valve trains of the intake valves. FIG. 3 is a longitudinal sectional view showing the structure of the intake camshaft 2, FIG. 4 is a top view showing the structure of a mounting portion for the second intake cam 11, and FIG. 5 is a sectional view of the mounting portion.

As shown in FIGS. 3 to 5, the intake camshaft 2 has a dual structure comprising a hollow first intake camshaft 21 and a second intake camshaft 22 inserted in the first intake camshaft. The first and second intake camshafts 21 and 22 are arranged concentrically with a gap between them and pivotably supported by a support portion 23 formed on a cylinder head of the engine 1. The first intake cam 10 is fixed to the first intake camshaft 21. Further, the second intake cam 11 is pivotably supported on the first intake camshaft 21. The second intake cam 11 comprises a substantially cylindrical support portion 11*a* and a cam portion 11*b*. The first intake camshaft 21 is inserted in the support portion 11*a*. The cam portion 11*b* protrudes from the outer periphery of the support portion 11*a* and serves to drive the second intake valve 13. The second intake cam 11 and the second intake camshaft 22 are fixed to each other by a fixing pin 24. The fixing pin 24 penetrates the support portion 11*a* of the second intake cam 11 and the first and second intake camshafts 21 and 22. The fixing pin 24 is inserted in a hole in the second intake camshaft 22 without a substantial gap, and its opposite end portions are crimped and fixed to the support portion 11*a*. A slot 25 through which the fixing pin 24 is passed is formed in the first intake camshaft 21 so as to extend circumferentially.

The second cam phase change mechanism 50 is an electric motor configured so that the gear 60*b* and the first intake camshaft 21 are fixed to its main body portion 50*a* and the second intake camshaft 22 is connected to a rotating shaft 50*b*. Thus, the second cam phase change mechanism 50 can continuously adjust the phase of the second intake camshaft 22 relative to the first intake camshaft 21, that is, the opening and closing timings of the second intake valve 13 relative to those of the first intake valve 12, toward the delay-angle side. If the opening and closing timings of the second intake valve 13 are delayed relative to those of the first intake valve 12, a period between the opening timing of the first intake valve 12 and the closing timing of the second intake valve 13, that is, an intake valve-open period, is extended. In contrast with this, the intake valve-open period is reduced if the phases are equalized by advancing the opening and closing timings of the second intake valve 13 relative to those of the first intake valve 12.

An ECU 40 is provided with an input-output device (not shown), storage devices such as ROM and RAM, central processing unit (CPU), etc., and generally controls the engine 1.

Various sensors, such as a crank angle sensor 41 and a throttle sensor 42, are connected to the input side of the ECU 40. The crank angle sensor 41 detects the crank angle of the engine 1. The throttle sensor 42 detects the opening of a throttle valve (not shown). Besides the OCV 34, moreover, the second cam phase change mechanism 50, a fuel injection valve 43, a spark plug 44, etc. are connected to the output side of the ECU 40. The ECU 40 determines the ignition timing, injection quantity, etc., based on detected information from the sensors, and drivingly controls the spark plug 44 and the fuel injection valve 43. Based on the detected information from the sensors, moreover, the ECU 40 drivingly controls the OCV 34, that is, controls the operations of first cam phase change mechanisms 20. The ECU 40 drivingly controls the second cam phase change mechanisms 50.

Figure 6:
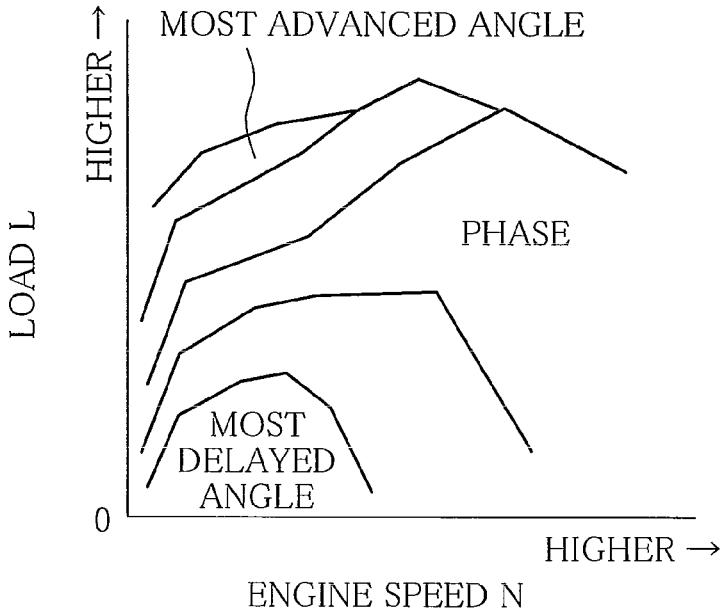
FIG. 6 is an example of a map used in operation setting for a first cam phase change mechanism.

FIG. 6 is an example of a map used in operation setting for the first cam phase change mechanism 20.

The ECU 40 operatively controls the first cam phase change mechanism 20 in accordance with a speed N and a load L of the engine. Specifically, as shown in FIG. 6, the ECU 40 controls the mechanism for the most delayed angle in low-load, low-speed operation, and advances the angles as the load or speed is increased. An intermediate phase is established in high-load, high-speed operation, and the most advanced angle position is reached in low-speed, high-load operation.

Figure 7:
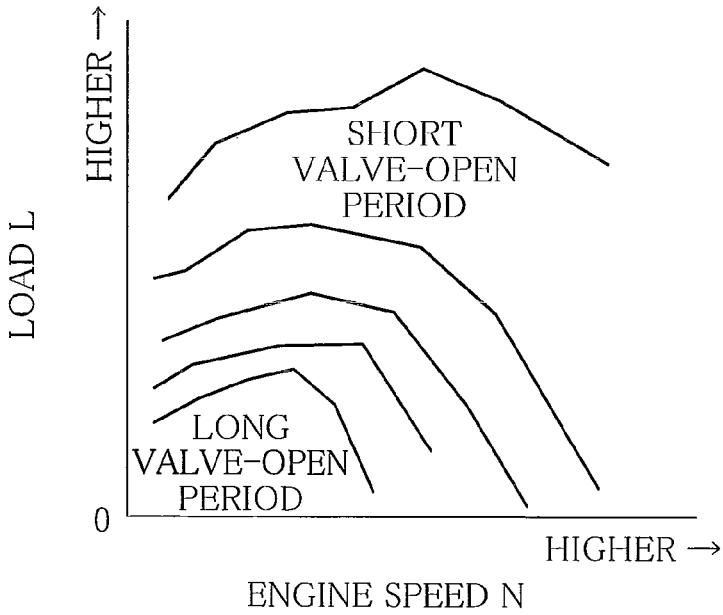
FIG. 7 is an example of a map used in operation setting for a second cam phase change mechanism.

FIG. 7 is an example of a map used in operation setting for the second cam phase change mechanism 50.

The ECU 40 operatively controls the second cam phase change mechanism 50 in accordance with the engine speed N and load L. Specifically, in the low-load, low-speed operation, as shown in FIG. 7, the ECU 40 controls the opening and closing timings of the second intake valve 13 relative to those of the first intake valve 12 toward the delay-angle side, thereby extending the intake valve-open period. Further, the ECU 40 operatively controls the second cam phase change mechanism 50 so that the valve-open period is reduced as the load or speed increases.

Figure 8:
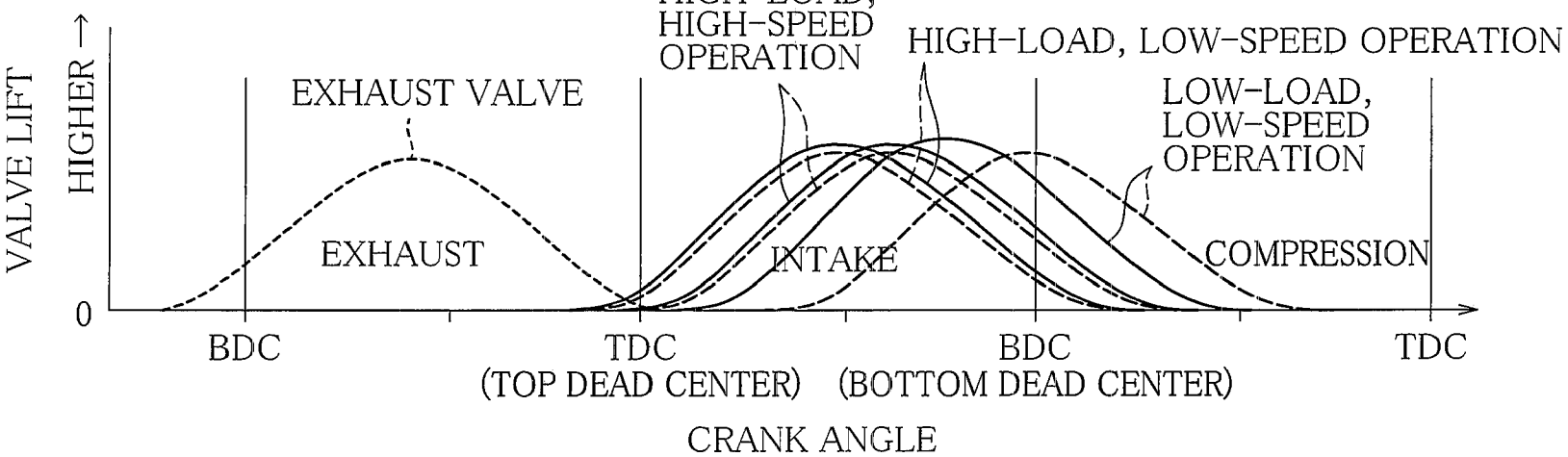
FIG. 8 is a time chart showing transitions of lifts of intake valves.

FIG. 8 is a time chart showing transitions of lifts of the intake valves.

In the low-load, low-speed operation of the engine 1 of the present embodiment, as shown in FIG. 8, the valve timing of the second intake valve 13 is delayed by the first cam phase change mechanism 20 and its valve-open period is extended by the second cam phase change mechanism 50. Thus, the closing timing of the second intake valve 13 can be greatly delayed. Thus, pumping loss can be considerably mitigated to greatly improve the fuel efficiency. By setting a variable phase range by the second cam phase change mechanism 50 to be greater than that by the first cam phase change mechanism 20, in particular, phase differences between the respective opening and closing timings of the first and second intake valves can be increased. Consequently, the closing timing of the second intake valve 13 can be delayed to the second half of a compression stroke, and pumping loss can be mitigated. If this is done, in-cylinder flow is enhanced, combustion stability can be improved even with mitigated pumping loss and at a low actual compression ratio with a small amount of air, and the fuel efficiency can be further improved. Since mixing between air and fuel is also enhanced, moreover, emission of unburned components in exhaust gas can be reduced. Since the variable phase range of the second cam phase change mechanism 50 is set independently of that of the first cam phase change mechanism 20, furthermore, the design flexibility and vehicle mountability can be improved. Thus, the range setting can be easily achieved with the enlargement of the entire variable valve train and increase in the longitudinal dimension of the engine suppressed. Further, the layout flexibility for application to the engine can be enhanced.

In the high-load, high-speed operation, on the other hand, the second intake valve 13 is brought to the intermediate phase by the first cam phase change mechanism 20, and the valve-open period is reduced by the second cam phase change mechanism 50. Therefore, the closing timing of the second intake valve 13 is advanced relative to the case of the low-load, low-speed operation. If the second intake valve 13 is closed in, for example, the first half of the compression stroke, that is, near a region where intake air is pushed back into an intake port by a piston, the charging efficiency of the intake air can be enhanced to secure the output.

In the high-load, low-speed operation, moreover, the opening timing of the first intake valve 12 is advanced by the first cam phase change mechanism 20. Thus, by advancing the opening timing of the first intake valve 12 to or just ahead of the top dead center (TDC), for example, pumping loss in an initial stage of an intake stroke can be mitigated, and a strong inertial or pulsating supercharging effect can be obtained. In the high-load, low-speed operation, e.g., in a start mode, therefore, the starting performance can be improved by securing good combustibility along with improved fuel efficiency.

In the present embodiment, the first and second cam phase change mechanisms 20 and 50 are located on the front end portions of the exhaust and intake camshafts 3 and 2, respectively. Thus, the cam phase change mechanisms 20 and 50 can be easily installed, and the engine 1 can be compactified without substantially increasing its transverse dimension. Moreover, the first cam phase change mechanism 20 is expected to drive the first and second intake valves 12 and 13 and the second cam phase change mechanism 50. Even if the mechanism 20 is enlarged to increase its ability for this purpose, however, the longitudinal dimension and the like of the engine can be prevented from increasing.

Further, the vane-type cam phase change mechanism and electric motor are used as the mechanisms for changing the opening and closing timings of the intake valves 12 and 13. Therefore, friction can be reduced when compared with the case of a mechanism that changes the closing timing of an intake valve by increasing or reducing the valve lift, and the operation reliability and durability of the valve train can be improved.

In the present embodiment, furthermore, the second cam phase change mechanism 50 is an electric motor, so that highly responsive drive can be achieved even at low temperature. Thus, the phases of the intake cams can be quickly controlled even in, for example, a cold start mode. Further, the fuel efficiency can be improved relative to that of the hydraulic actuator. Like the first cam phase change mechanism 20, moreover, the second cam phase change mechanism 50 may be of a hydraulic drive type.

In the low-load, low-speed operation, moreover, the ECU 40 controls the second cam phase change mechanism 50 to extend the valve-open period after controlling the first cam phase change mechanism 20 for the most delayed angle. Thus, the cam phase change mechanisms 20 and 50 are not simultaneously activated but sequentially controlled, so that accurate operation control can be achieved without involving a deficiency of oil pressure even in the case where both the cam phase change mechanisms 20 and 50 are of the hydraulic drive type.

In the present invention, the map used in the operation setting for the first cam phase change mechanism 20 is not limited to the one shown in FIG. 6. Further, the map used in the operation setting for the second cam phase change mechanism 50 is not limited to the one shown in FIG. 7. At least in the low-load, low-speed operation, according to the present invention, it is necessary only that the first cam phase change mechanism 20 be controlled for the most delayed angle and that the second cam phase change mechanism 50 be set so as to make the valve-open period relatively long. Setting for other regions depends on the engine properties. Furthermore, the first and second cam phase change mechanisms 20 and 50 should preferably be provided with a most-delayed-angle locking mechanism and a most-advanced-angle locking mechanism, respectively. By doing this, an accurate switching point can be set for the cam phase change mechanisms 20 and 50.

A spring should preferably be provided for urging the second cam phase change mechanism 50 in the direction to reduce the phase difference between the first and second intake camshafts 21 and 22. By doing this, variation of the phase difference between the first and second intake valves 12 and 13 can be suppressed, so that the valve-open period can be stably controlled.

What is claimed is:

1. An internal combustion engine with a variable valve gear, wherein each cylinder is provided with a first intake valve and a second intake valve, and a first intake cam for driving the first intake valve and a second intake cam for driving the second intake valve are coaxially pivotally supported on an intake camshaft, and the intake camshaft is configured so that a first intake camshaft to which the first intake cam is fixed and a second intake camshaft to which the second intake cam is fixed are located coaxially, the internal combustion engine comprising:

a first cam phase change mechanism which varies respective phases of the first and second intake cams relative to a crankshaft of the internal combustion engine; and a second cam phase change mechanism which varies a phase of the second intake cam relative to the first intake cam, the second cam phase change mechanism being set to have a variable-phase angular range wider than that of the first cam phase change mechanism, the second cam phase change mechanism varying a phase of the second intake camshaft relative to the first intake camshaft, and the first cam phase change mechanism varying the phase of the second cam phase change mechanism relative to the crankshaft.

2. The internal combustion engine with a variable valve gear according to claim 1, further comprising a locking mechanism configured to lock the first cam phase change mechanism at a most delayed angle thereof and the second cam phase change mechanism at a most advanced angle thereof.

3. The internal combustion engine with a variable valve gear according to claim 2, wherein the first cam phase change mechanism is disposed on one end portion of an exhaust camshaft, and the second cam phase change mechanism is disposed on one end portion of the intake camshaft.

4. The internal combustion engine with a variable valve gear according to claim 1, wherein the first cam phase change mechanism is disposed on one end portion of an exhaust camshaft, and the second cam phase change mechanism is disposed on one end portion of the intake camshaft.

5. The internal combustion engine with a variable valve gear according to claim 1, wherein the second cam phase change mechanism is an electric actuator.

* * * * *